United States Patent [19]

Takeyama et al.

[11] 4,407,078

[45] Oct. 4, 1983

[54] DRIVE SYSTEM FOR ROTARY DRUM TYPE DEHYDRATING APPARATUS

[75] Inventors: Kojiro Takeyama, Kawanishi; Toru Shimotake, Osaka, both of Japan

[73] Assignee: Matsushita Electric Industrial Co., Ltd., Osaka, Japan

[21] Appl. No.: 271,269

[22] Filed: Jun. 8, 1981

[30] Foreign Application Priority Data

Jun. 16, 1980 [JP] Japan ..... 55-81914

[51] Int. Cl.[3] ..... F26B 11/04

[52] U.S. Cl. ..... 34/133; 34/139

[58] Field of Search ..... 34/133, 139, 132

[56] References Cited

U.S. PATENT DOCUMENTS

| | | | |
|---|---|---|---|
| 2,925,665 | 2/1960 | Smith | 34/133 |
| 2,975,528 | 3/1961 | Shewmon | 34/133 |
| 3,060,593 | 10/1962 | Flora et al. | 34/133 |
| 3,167,409 | 1/1965 | Brucken | 34/133 |
| 3,471,940 | 10/1969 | Smith | 34/133 |

FOREIGN PATENT DOCUMENTS

| | | | |
|---|---|---|---|
| 1290329 | 3/1962 | France | 34/133 |

*Primary Examiner*—Larry I. Schwartz

*Attorney, Agent, or Firm*—Stevens, Davis, Miller & Mosher

[57] ABSTRACT

A drive system for rotary drum type drying apparatus including an axial air-gap induction motor mounted in the substantially central portion of a rear surface member of an outer case containing a rotary drum, a blower mounted on a rotor or a rotor shaft of the motor, and a speed reduction gear unit having an input connected to the rotor shaft and an output connected to the central portion of a rear wall of the rotary drum for rotating the rotary drum by transmitting the torque of the motor thereto while reducing the rotational speed. The structural arrangement that the motor, the blower fan, the speed reduction gear unit and the rotary drum are aligned with one another by the rotor shaft permits the drying apparatus to have an overall compact size while minimizing the number of necessary components parts and enabling the drying apparatus to be used in a long service life.

9 Claims, 4 Drawing Figures

DRIVE SYSTEM FOR ROTARY DRUM TYPE DEHYDRATING APPARATUS

BACKGROUND OF THE INVENTION

The present invention relates to a drive system for a drying apparatus and more particularly to a drive system for a compact rotary drum type drying apparatus.

It is already known from prior art patents relating to drying apparatus that a drive system having a radial air-gap induction motor is provided in an outer case of the drying apparatus for driving a rotary drum through a pulley and drive combination.

For example, U.S. Pat. No. 2,925,665 discloses a rotary drum type drying apparatus having a drive system which comprises a radial air-gap induction motor located on the bottom of the outer case and for driving the rotary drum as well as a blower through pulleys and drive belts which form a two stage speed reduction mechanism for speed variation from the 1500–1800 r.p.m. range of the motor to the 40–50 r.p.m. range to suitably drive the rotary-drum with the maximum efficiency. However, such a drive system should include a complicated drive pulley and belt mechanism having the two stage speed reduction.

Further, U.S. Pat. No. 3,471,940 discloses a drying apparatus including a drive system which comprises a drive pulley of a small diameter fitted onto the shaft of a radial air-gap induction motor. This drive pulley cooperates with a drive belt running around the outer periphery of a rotary drum so as to rotate the latter with the maximum efficiency. Since the diameter of the drive pulley is extremely less than that of the rotary-drum, an idler pulley is inevitably provided for tensioning the drive belt so as to prevent the drive pulley from being slipping on the drive belt.

Further, these prior art drive systems should have a bearing unit mounting a blower fan and another pulley and belt mechanism for driving the blower fan. Further, in these prior art drive systems, the drive motor should be mounted on the bottom of the outer case with a some clearance between the rotary drum and the drive motor in order to avoid the interference with the rotary drum rotating, which inevitably increases the dimension of the outer case with having a large dead space, causing an increase in the height of the outer case. Therefore, the access opening of the drying apparatus must be positioned at a relatively high level. It presents a problem when the drying apparatus is arranged above a washing apparatus, since, in such a case, accessibility of fabrics to be dryed becomes worse.

SUMMARY OF THE INVENTION

Therefore, it is an object of the present invention to provide an improved drive system for a compact drying apparatus which obviate the aforementioned disadvantages of the prior art.

It is a further object of the invention to provide an improved drive system having no pulley and belt combination for rotating a rotary-drum and a blower fan.

It is a further object of the invention to provide an improved drive system aligned with the rotating shaft of the rotary-drum without locating any component of the former below the rotary drum, thereby to minimize the overall dimension of the drying apparatus by reducing the vertical dimension of the outer case thereof.

Accordingly, the present invention provides a drive system for a rotary drum type drying apparatus including a rotary drum and a blower fan, comprising an axial air-gap motor mounted substantially in the central portion of a rear wall of an outer case of the drying apparatus and having a drive shaft onto which the blower fan is mounted; and a speed reduction gear unit having an input connected to the drive shaft of the motor and an output connected to the central portion of the rear wall of the rotary drum.

In view of the above construction according to the present invention, a drive pulley and belt combination can be eliminated and the overall dimension of the drying apparatus is minimized. Further, it is possible to decrease noises, since the drive pulley and belt combination which is the source of noises is not used in the drive system for the drying apparatus.

Additional and other objects, features and advantages of the invention will become apparent from the description set forth hereinafter when considered in conjunction with the accompanying drawings.

DESCRIPTION OF THE PREFERRED EMBODIMENT

Before turning to the preferred embodiment of the present invention, an explanation will be made to a prior art drying apparatus shown in FIG. 4 in order to clarify advantages of the present invention.

Figure 4:
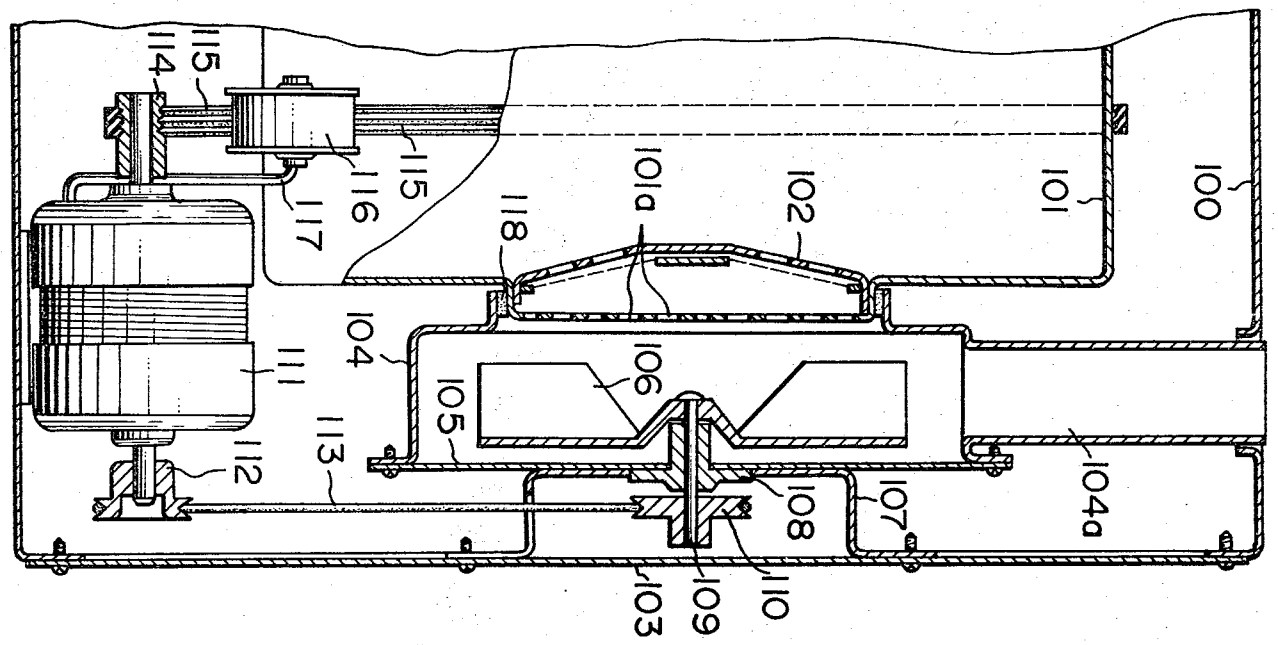
FIG. 4 is a fragmentary sectional view of a prior art fabric drying apparatus, corresponding to FIG. 3.

FIG. 4 is a fragmentary sectional view of a drying apparatus of the prior art using a radial air-gap induction motor explaiend hereinabove, showing a driving system thereof. As shown in FIG. 4, a rotary drum 101 is supported in an outer case 100 and has at its rear wall a filter 102 mounted therein. The outer case 100 comprises a rear plate 103. A blower fan 100 is mounted in a casing which is composed of a first case 104 and a second case 105 and is supported by the rear plate 103 through a bracket 107. The blower fan 106 has a shaft 109 journaled by a bearing 108 and supports a blower pulley 110 at one end portion thereof remote from the blower fan 106. A radial air-gap motor 111 is located on the bottom of the outer case 100 and has a drive pulley 112 mounted onto one end of its output shaft, thereby transmitting the rotating torque of the motor to the blower pulley 110 through a belt 113. The rotating torque of the motor 111 is also transmitted from a drum drive pulley 114, fitted onto the other end of the output shaft, to a belt 115 wound around the outer periphery of the rotary drum 101. Since the diameter of the drum drive pulley 114 is very small, the speed reduction ratio is very high. In order to keep the tension of the belt 115 constant and to avoid irregularities in the travel path of the belt 115, an idler pulley 116 is supported by a spring-loaded supporting member 117. The numeral 118 designates a bearing seal slidably engaged with a cylindrical flange formed in the rear wall of the rotary drum 101.

In the aforesaid construction, the air inside the rotary drum 101 is drawn by suction through the filter 102 and a ventilating port 101*a* formed in a rear wall of the rotary drum 101 into the blower casing 104, 105 as the blower fan 106 rotates, and is discharged through an exhaust port 104*a* formed in the first case 104 so as to be vented from the drying apparatus.

Since the belt 115 of the aforesaid construction is stretched under high tension, the motor 11 should have a high output power. Further since the belt 115, the drum pulley 114, the belt 115 and the rotary drum 101 are in sliding contact with each other so as to produce noises.

The motor 111 is disposed beneath the rotary drum 101 in the outer case 100, which increases the height of the outer case 100, thereby it cannot be expected to obtain a compact drying apparatus.

Generally, the speed of the motor 111 in the range between 1500 and 1800 r.p.m. is reduced to about 50 r.p.m. for rotating the rotary drum 101, at which drying efficiency is maximum. Therefore, it is necessary to lessen the diameter of the drive pulley 114. The smaller the diameter of the drive pulley 114, the higher becomes the incidence of slip. Thus, the idler pulley 116 and the supporting member 117 are inevitably provided to exert the belt 115 under high tension in order to avoid the occurrence of slip, which renders the apparatus complex in construction.

The distance between the axes of the blower pulley 110 and the blower drive pulley 112 is large because the distance is governed by the radius of the rotary drum 101. Thus, a belt 113 that travels at a considerably high speed seriously vibrates. Further, the belt 113 itself and the shafts of the pulleys 110, 112 might be subjected to stress. Therefore, it cannot be expected to use these components in a long service life.

Figure 1:
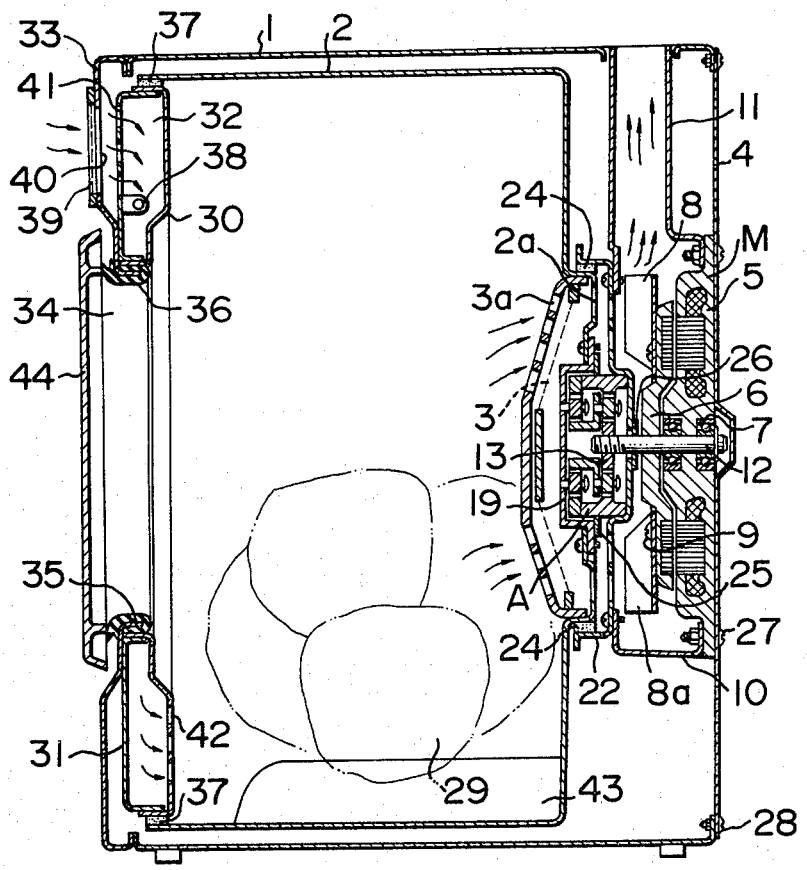
FIG. 1 is a vertical sectional view of the fabric drying apparatus in its entirety.
Figure 2:
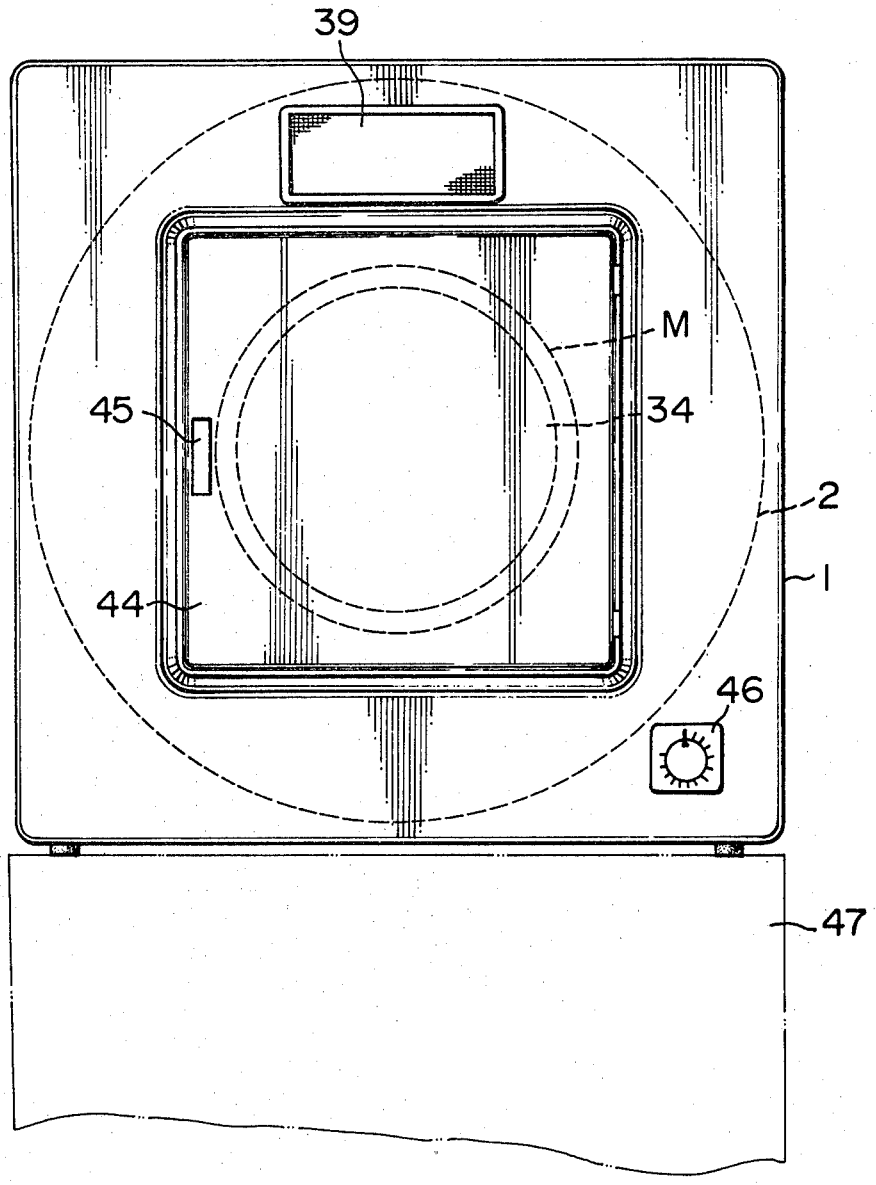
FIG. 2 is a front view of the fabric drying apparatus shown in FIG. 1.
Figure 3:
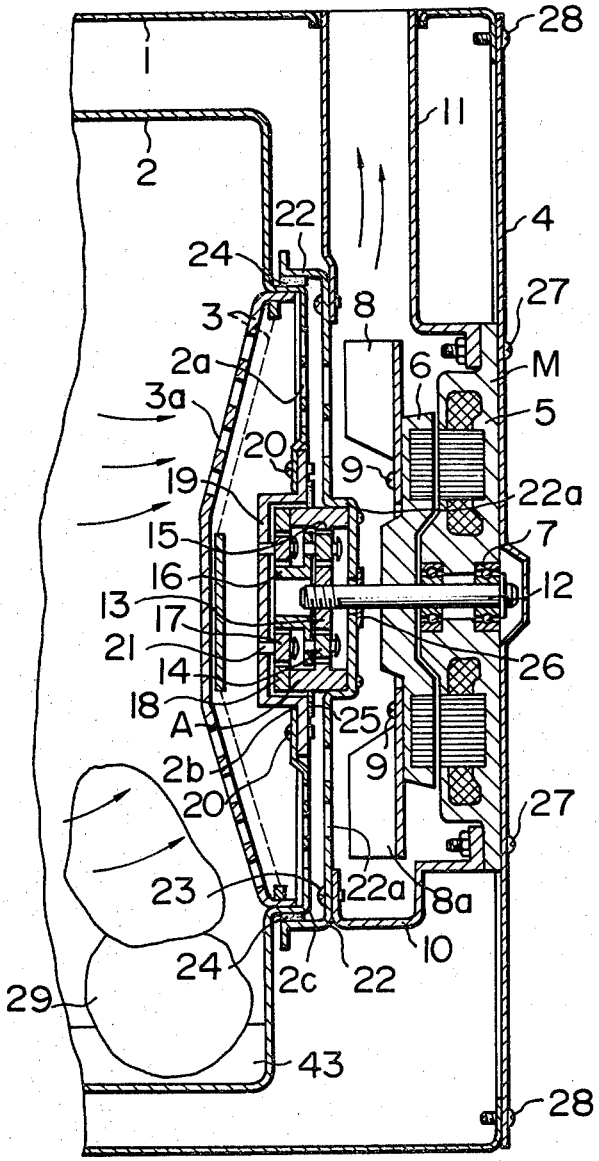
FIG. 3 is a fragmentary sectional view, on an enlarged scale, of the fabric drying apparatus shown in FIG. 1, showing its drive system.

A preferred embodiment of the invention will now be described by referring to the drawings. In FIGS. 1 through 3, the fabric drying apparatus comprises an outer case 1 encasing therein a rotary drum 2 (hereinafter denoted as "drum") which carries a saucer-shaped filter 3 attached to the inside of a rear wall thereof. The outer case 1 includes a rear plate 4 which supports on its inner surface an axial air-gap induction motor M (hereinafter denoted as "motor") having a stator 5 and a rotor 6 in the central portion thereof. The rotor 6 which is journaled by ball bearings 7 mounted in the stator 5, carries thereon, with screws 9, a blower fan 8 in a disc-like shape, having blades 8*a* attached to the outer periphery thereof and extending radially outwardly therefrom. In the embodiment of the drying apparatus according to the invention, the air in the drum 2 is drawn by suction into a casing 10 in which the blower fan 8 is disposed, through perforations 3*a* of the filter 3 and openings 2*a* formed in the rear wall of the drum 2, and is then exhausted from the apparatus through an exhaust port 11 communicating with the casing 10.

The rotor 6 has a rotor shaft 12 extending through its central portion thereof and secured thereto which is rotatably supported at one end portion thereof by the ball bearings 7 and engaged at the other end with a sun gear 13 located at the input side of a speed reduction gear unit A.

The speed reduction gear unit A will be described in detail. The speed reduction gear unit A comprises a planetary gear mechanism including, in addition to the sun gear 13, a plurality of planetary gears 14 (three in number in the embodiment) meshing with the sun gear 13, an internal gear 15 meshing with the planetary gears 14, an annular member 16 holding the shaft of the planetary gears 14, a plurality of output gears 17 (three in number in the embodiment) meshing with a serration formed in the annular output member 16, and an internal gear 18 meshing with the output gears 17. The internal gear 15 serves as a main body of the speed reduction gear unit A.

In the planetary gear mechanism of the aforesaid construction, the rotation of the sun gear 13 causes the planetary gear 14 to circulate along the inner surface of the internal gear 15 while revoluting on their own axes. The circulation of the planetary gears 14 along the inner surface of the internal gear 15 causes the output member 16 to rotate so as to allow the output gears 17 to circulate along the inner surface of the internal gear 18 while revolving on their own axes. It is clearly understood from the above description that the speed reduction gear unit A consists of a planetary gear transmission of the two stage speed reduction type.

The speed reduction gear unit A of the aforesaid construction operates such that the speed of the motor M about 1800 r.p.m. is reduced to about 45 r.p.m. at which speed the output gears 17 circulate along the inner surface of the internal gear 18, that is: the speed reduction rate is 1:40.

The numeral 19 designates a coupling extending through an opening 2*b* formed in the rear wall of the drum 2 toward the filter 3 and fixed by screws 20 to the edges of the opening 2*b*. This coupling 19 is connected to the output gears 17 through connecting rods 21. Thus, the circulation of the output gears 17 along the inner surface of the internal gear 18 causes the drum 2 to rotate through the coupling 19.

The numeral 22 designates a support plate supporting the speed reduction gear unit A in a recess 22*a* formed in the center portion thereof and also rotatably supporting the peripheral portion of a projection 2*c* formed in the rear wall of the drum 2. The support plate 22 is fixed by screws 23 to the casing 10. Alternatively, the support plate 22 may be joined by spot-welding to the casing 10. A bearing 24 is mounted between the support plate 33 and the projection 2*c* of the drum 2 for allowing the slidably rotating movement of the drum 2. Seals 25 and 26 are used to seal between the periphery of the speed reduction gear unit A and the coupling 19 and between the support plate 22 and the rotor shaft 12, respectively, in order to prevent the introduction of foreign objects, such as lint or dust into the speed reduction gear unit A. The seals 25 and 26 which may be made of felt materials, are respectively mounted on the coupling 19 and the support plate 22. It will be understood from the foregoing description that the speed reduction gear unit A is located in a space defined between the filter 3 attached to the rear wall of the drum 2 and the blower fan 8 supported on the rotor 6.

The numeral 27 designates a plurality of screws securing the stator 5 of the motor M to the central portion of the rear plate 4. By tightening nuts onto the screws 27, the casing 10 can be secured to the rear plate 4 which is in turn secured to the edge of a rear portion of the outer case 1 by screws 28. The numeral 29 designates clothes in the drum 2 to be dried.

The numeral 30 designates a drum front plate forming a front wall of the drum 2 in a ring-like shape, since a circular opening is defined in its central portion. Another front plate 31 in a ring-like shape is arranged in the front of and in the spaced relation with the front plate 30 so as to define therebetween an air passage 32 in a doughnut-like shape. More specifically, both front plate 30, 31 are bent so that their inner peripheries overlap each other, and they are joined together at the overlapping portions by spot-welding or by screws.

The numeral 33 designates a front plate of the outer case 1 formed in its central portion with an access opening 34 and joined, by welding or screws, at its periphery to the front end of the outer case 1. The access opening 34 is formed by a cylindrical flange 35 of the front plate 33, having an annular packing 36 fitted therein and held in position. The packing 36 is hermetically fitted at its outer peripheral surface in the inner peripheral wall portion of the center opening of the front plate 30. When it is necessary, the front plates 31, 33 may be interconnected by screws to fix the drum front plate 30 with respect to the outer case 1.

The numeral 37 designates a bearing supported by the outer peripheral wall of the drum front plate 30 for allowing the slidably rotating movement along the inner peripheral surface of the front end of the peripheral wall of the drum 2. The bearing 37 may be made of resin or felt materials, having an excellent wear resistant and hermetical property.

The numeral 38 designates a heat generating element secured to the front plate 31 and located in the air passage 32, which may be a nichrome wire of a positive temperature coefficient heater (PTC heater) which has a characteristic such that, when the temperature exceeds a certain level, the amount of heat generated is automatically suppressed by an increase in resistance. The front plate 33 is formed with an opening 40 in its upper portion which is detachably fitted with an air filter 39 that can be removed from the opening 40. The front plate 31 is formed with a plurality of apertures 41 in positions corresponding to the opening 40. The front plate 30 is formed with a plurality of apertures 42 in its lower portion for drawing heated air therethrough from the air passage 32 to the interior of the drum 2.

A plurality of baffles 43 are arranged on the inner surface of the cylindrical wall of the drum 2 for lifting the clothes 29 by engaging the same upon the rotation of the drum 2 so as to cause the same to drop from a suitable height, thereby to move the clothes 29 while allowing the same to impinge on the inner wall surface of the drum 2. The access opening 34 is provided with a door 44 for opening and closing the same, which is brought into hermetical sealing contact with the packing 36 when it is closed. The door 44 is hingedly supported at one side and provided with a handle 45 at the other side. The numeral 46 designates a time switch for controlling the time for passing a current to the motor M, which can be manually actuated to energize the heat generating element 38 and the motor M when it is turned on. The numeral 47 designates a deck for installing the drying apparatus above a washing machine (not shown).

In operation, actuation of the time switch 46 causes the heat generating element 38 to generate heat and the motor M to rotate. The rotation of the motor M allows the drum 2 to rotate through the speed reduction gear unit A and further the blower fan 8 mounted on the rotor 6 to simultaneously rotate. The rotation of the blower fan 8 causes air to be drawn by suction from the outside of the apparatus through the air filter 39, the opening 40 and the aperture 41 into the air passage 32 to be heated by the heat generating element 38. The heated air enters through the aperture 42 into the drum 2 where the clothes 29 are heated and dried. The moist air produced by the drying operation is introduced, through the filter 3, the openings **2*a* formed in the rear wall of the drum 2, and an opening formed in the recess 22*a* of the support plate 22, into the casing 10, from which it is exhausted to outside through the exhaust port 11. The filter 3 catches lint and other foreign objects discharged from the drum 2. By performing the aforesaid operation, the drying of the cloths 29** can be achieved.

By virture of the structural arrangement described hereinabove, the invention offers many advantages. More specifically, according to the invention, the axial air-gap induction motor M is mounted in the central portion of the rear plate 4 of the outer case 1 containing the drum 2, and the blower fan 8 is directly mounted on the rotor 6 of the motor M having the rotor shaft 12 connected to the sun gear 13 on the input side of the speed reduction gear unit A with the output gears 17 being connected through the coupling 19 to the rear wall of the drum 2. By this arrangement a transmission consisting of pulleys and belts as used in the prior art, as shown in FIG. 4, for example, is not necessary. Furthermore, the arrangement eliminates a complicated mechanism for achieving the belt under a high tension. Thus, the wear that might otherwise be caused on the belt by slip and the production of noises can be avoided, thereby expecting the long service life of the drying apparatus.

The use of synthetic plastics, such as polyacetal or polymide resin, for forming the speed reduction gear unit A enables the unit to generate low noises and which is also low in cost and increases the durability of the unit A.

The motor M is what is generally referred to as a "flat motor" which is of small thickness and of a disc-like shape. This motor is mounted on the rear wall of the outer case 1 together with the blower fan 8, thereby eliminating an extra space beneath the drum 2 for mounting a motor in the conventional drying apparatus of the prior art. Thus, the outer case 1 is essentially free of dead space. Particularly, because of no extra space in the lower portion of the outer case 1, the overall height of the outer case 1 can be greatly reduced so as to be substantially of the same dimensions as the drum. A reduction in the overall height of the outer case 1 offers many advantages. It is possible to obtain an overall compact size in a drying apparatus so that the apparatus can be readily transported from one position to another and the accessibility of clothes 29 through the access opening 34 of the drum 2 can be increased because the position of the access opening 34 becomes suitably lowered and the drying apparatus can be readily accessed when it is placed on the deck 47 above the washing machine.

The use of the speed reduction gear unit A for changing the rotational speed of the motor M in the range between 1500 and 1800 r.p.m. to the speed of the rotary drum 2 in the range between 40 and 50 r.p.m. at which drying efficiency is maximum can eliminate a loss of torque. Thus, it is possible to drive the rotary drum 2 and blower fan 8 even in a low output power.

The speed reduction gear unit A is disposed in a space between the blower fan 8 and the filter 3 on the rear wall of the drum 2 so that the drum 2, the speed reduction gear unit A and the motor M are aligned with one another axially of the rotor shaft 12, thereby to enables the depth of the drum 2 to be maximum without increasing the depth of the outer case 1. Particularly by forming the filter 3 to project deeply into the drum 2 as shown FIGS. 1 and 3, it is possible to increase the aforesaid space disposed rearwardly of the filter 3 so that design of the speed reduction gear unit A can be facilitated.

The blades 8*a* of the blower fan 8 have not to be located in the center of the rotation of the blower fan 8 but can be arranged radially in its marginal portion. By virtue of this arrangement, there can be provided a space near the center of rotation of the blower fan 8. The support plate 22 supports the speed reduction gear unit A in its recess 22*a* which projects into the space near the blower fan 8, and the coupling 19 extends through the opening 26 in the rear wall of the drum 2 toward the filter 3. Thus, there is an enough space between the coupling 19 and the blower fan 8 for mounting the speed reduction gear unit A. More specifically, the space can be formed in such a manner that the rear wall of the drum 2 and the casing 10 are closed to each other so that there is no appreciable increase in the distance between the rear plate 4 of the outer case 1 and the rear wall of the drum 2, although the motor M, the blower fan 8 and the speed reduction gear unit A are aligned with one another axially of the rotor shaft 12. Thus no essential change occurs in the depth of the drum 2. The drum 2 can have a volume necessary for satisfactorily performing the drying operation.

The casing 10 is secured by the screws 27 to the rear plate 4 of the outer case 4 together with the motor M, and holds the support plate 22 in position, which eliminates the number of necessary parts.

The use of the planetary gear mechanism for the speed reduction gear unit A gives a reduction in the depth of the outer case 1. More specifically, the sun gear 13, the planetary gear 14 and the internal gear 15 are arranged in a direction at right angle to the length of the rotor shaft 12, and the output member 16, the output gears 17 and the internal gear 18 are also arranged in the direction at right angle to the rotor shaft 12, causing no increase in the thickness of the speed reduction gear unit A in the lengthwise direction of the rotor shaft 12.

The arrangement that the motor M is located on the center axis of the drum 2 enables the drum to be increased in size while the size of the outer case 1 remains constant, thereby permitting the amount of clothes to be dried in a single drying operation to be increased. The fact that the motor M is located on the center axis of the drum 2 allows the drying apparatus to be laid on its one side during operation. When the drying apparatus is placed on a washing machine, no difficulty is encountered in the access of the clothes in the apparatus, because the height of the access opening is not so high when the drying apparatus is positioned above the washing machine.

While the embodiment has been shown and described as having the blower fan 8 mounted on the rotor 6, it is to be understood that the same effects can be achieved by securing the blower fan 8 to the rotor shaft 12.

The invention has shown and described hereinabove by referring to a preferred embodiment thereof. It is to be understood, however, that the invention is not limited to the specific form of the embodiment and that many changes and modifications may be made without departing from the scope of the invention.

What we claim is:

1. A drive system for a rotary drum type drying apparatus including an outer case having a rear surface member, a rotary drum encased in said outer case and having a rear wall, a filter disposed in the central portion of said rear wall and allowing air to be discharged from said rotary drum therethrough and a blower fan positioned adjacently to said filter, comprising:

an axial air-gap induction motor mounted rearwardly of said blower in the central portion of said rear surface member and including a rotor and a rotor shaft, said blower fan being supported by said rotor or said rotor shaft; and a speed reduction gear unit disposed in a space defined between said filter and said blower fan and having an input connected to one end of said rotor shaft and an output connected to the central portion of said rear wall of the rotary drum.

2. A drive system as claimed in claim 1, wherein said speed reduction gear unit includes a planetary gear mechanism comprising a sun gear supported on the rotor shaft, a plurality of planetary gears meshing with said sun gear, and internal gear meshing with said planetary gears so as to allow the latter to circulate therealong while revolving on their own axes.

3. A drive system as claimed in claim 1, wherein said blower includes a plurality of radial blades arranged in the peripheral edge portion thereof and defines a space in the central portion thereof, and said drive system further comprises a support plate having a recess portion holding therein said speed reduction gear unit, said recess portion projecting into said space; and a coupling for connecting said rear wall of said rotary drum with said speed reduction gear unit, said coupling projecting into the rotary drum.

4. A drive system as claimed in claim 3, wherein said blower is encased in a casing secured to the rear surface member of the outer case together with said axial air-gap induction motor, said casing holding said support plate in a predetermined position.

5. A drive system as claimed in claim 1, wherein said blower fan is fixed to the rotor of said axial air-gap induction motor.

6. A drive system as claimed in claim 2, further comprising:

an annular member between said plurality of planetary gears and said drum, comprising a serrated cylindrical portion extending toward said drum;

a first means for securing said annular member to said plurality of planetary gears;

a second plurality of planetary gears meshing with said serrated cylindrical portion;

a second internal gear meshing with said second plurality of planetary gears; and a second means for securing said second plurality of planetary gears to said drum to impart movement from said second plurality of planetary gears to said drum.

7. A drying apparatus, comprising:

an outer casing having a back wall;

a rotary drum, having a rear wall with a central opening, in said outer casing, the rear wall of said drum being spaced from the back wall of said casing;

a filter in the central portion of said rear wall;

a drive system between the rear wall of said drum and the back wall of said casing, comprising:

an axial air-gap induction motor having a stator secured to the interior of the back wall of said casing and a rotor adjacent to said stator;

a blower secured to said rotor;

a first shaft extending from said rotor toward said drum;

a sun gear secured to said shaft;

a speed reduction unit between said blower and said drum, comprising:

a first plurality of planetary gears radially outwardly of and in mesh with said sun gear;

a first fixed internally toothed gear radially outwardly of and in mesh with said first plurality of planetary gears;

an annular member between said first plurality of planetary gears and said drum, comprising a serrated cylindrical portion extending toward said drum;

a first means for securing said annular member to said first plurality of planetary gears;

a second plurality of planetary gears radially outwardly of and in mesh with said serrated cylindrical portion;

a second fixed internally toothed gear radially outwardly of and in mesh with said second plurality of planetary gears; and second means for securing said second plurality of planetary gears to said drum to impart movement from said second plurality of planetary gears to said drum.

8. A drying apparatus as claimed in claim 7, wherein said second fixed gear is secured axially adjacently to said first fixed gear.

9. A drying apparatus as claimed in claim 7, further comprising a support plate for supporting said speed reduction unit.

* * * * *